US006298695B1

(12) United States Patent
Vézina et al.

(10) Patent No.: US 6,298,695 B1
(45) Date of Patent: Oct. 9, 2001

(54) EQUIPMENT SECURITY APPARATUS

(75) Inventors: Donald Vézina, 486 Marceau, Repentigny Quebec (CA), J6A 6G3; Pierre Patenaude, Montreal (CA); André Lafleur, Boucherville (CA); Eric Buissière, Ste-Julie (CA)

(73) Assignee: Donald Vezina, Repentiqny (CA)

( * ) Notice: Subject to any disclaimer, the term of this patent is extended or adjusted under 35 U.S.C. 154(b) by 0 days.

(21) Appl. No.: 09/455,244

(22) Filed: Dec. 6, 1999

(51) Int. Cl.[7] ..... E05B 69/00
(52) U.S. Cl. ..... 70/58; 70/19; 248/551
(58) Field of Search ..... 70/14, 18, 19, 70/57, 58; 248/551–553

(56) References Cited

U.S. PATENT DOCUMENTS

| | | | | |
|---|---|---|---|---|
| 4,418,551 | * | 12/1983 | Kochakis | 70/18 |
| 4,585,202 | | 4/1986 | Parsekian | 248/553 |
| 4,696,449 | | 9/1987 | Woo et al. | 248/553 |
| 4,884,420 | | 12/1989 | Finkel et al. | 70/58 |
| 5,052,651 | | 10/1991 | Guddee | 248/552 |
| 5,076,079 | | 12/1991 | Monoson et al. | 70/58 |
| 5,085,395 | | 2/1992 | Frater et al. | 248/522 |
| 5,135,197 | | 8/1992 | Kelley et al. | 248/551 |
| 5,582,044 | * | 12/1996 | Bolich | 70/58 |
| 5,595,074 | * | 1/1997 | Munro | 70/58 |
| 5,642,634 | * | 7/1997 | Perry | 70/18 |
| 5,645,261 | * | 7/1997 | Glynn | 70/58 X |
| 5,660,451 | | 8/1997 | Glynn | 312/223.2 |
| 5,697,233 | * | 12/1997 | Albert et al. | 70/58 |
| 5,722,266 | * | 3/1998 | Yeager et al. | 70/57 |
| 5,816,076 | * | 10/1998 | Biederman et al. | 70/58 X |
| 5,836,183 | * | 11/1998 | Derman | 70/58 |
| 5,914,461 | * | 6/1999 | Brandt | 70/58 X |
| 6,125,669 | * | 10/2000 | McDaid et al. | 70/58 |
| 6,125,672 | * | 10/2000 | Diez | 70/14 X |
| 6,138,483 | * | 10/2000 | Galant | 70/58 |

* cited by examiner

*Primary Examiner*—Suzanne Dino Barrett
(74) *Attorney, Agent, or Firm*—Goudreau Gage; Dubuc

(57) ABSTRACT

A security apparatus for preventing theft and/or tampering of an equipment or a part of this equipment, comprises a base member having a front wall, two opposite side walls and a rear wall. First and second elongated bent rods each include a first end section secured to the rear wall, a second end section secured to one of the two opposite side walls, a third rod section extending along a rear face of the equipment, and a fourth rod section extending along a top face of the equipment. The first and second elongated bent rods further comprise respective fifth rod sections extending along two opposite side faces of the equipment, respectively. A movement-restraining member extends along a front face of the equipment, this movement-restraining member comprising a key or combination lock for removably locking this movement-restraining member to the base member to thereby lock the equipment in the security apparatus. According to an alternative embodiment, the first and second elongated bent rods rotate about coaxial pivots located on opposite sides of the base member, a key lock removably locks these first and second rods on the front face of the base member, and a movement-restraining member secured to the rear face of the base member extends along the rear face of the equipment.

15 Claims, 13 Drawing Sheets

EQUIPMENT SECURITY APPARATUS

BACKGROUND OF THE INVENTION

1. Field of the Invention

The present invention relates to a security apparatus for the protection of equipment against theft and tampering. More specifically, the invention aims at providing a simple, aesthetical, adjustable, reliable and economical solution to the increasing problem of electronic equipment theft and/or tampering. The invention particularly addresses the even more actual problem of computer mutilation, that is theft of specific parts thereof, such as disk drives, expansion boards etc. from inside the equipment, leaving the most cumbersome pieces of hardware on the site.

2. Brief Description of the Prior Art

Solutions to this kind of problem have been proposed in the past but these prior art solutions all suffer from major drawbacks. U.S. Pat. No. 5,660,451 (Glynn) issued on Aug. 26, 1997 discloses a type of solution providing a closed while vented housing, fastened to the work surface, in which the equipment is nested leaving access to the front panel only. Although it is true that such a solution generally provides an efficient remedy against tampering, its main drawback is its very low level of flexibility to match the different sizes and shapes of equipment on the market.

A certain level of adaptability to size and shape is provided by the type of solution disclosed in U.S. Pat. No. 5,076,079 granted to Monoson et al., on Dec. 31, 1991 which squeezes the equipment between a pair of jaws, one of which can be moved to provide an adjustable width, while the other is removably assembled to the fastened base plate using a locking mechanism. That proposed solution however allows unlimited access to the inside of the equipment from the rear or front panel.

Other solutions such as those disclosed in U.S. Pat. No. 4,696,449 (Woo et al.) issued on Sep. 29, 1987, U.S. Pat. No. 5,085,395 granted to Frater et al., on Feb. 4, 1992 and U.S. Pat. No. 5,135,197 granted to Kelley et al., on Aug. 4, 1992 provide a reasonable protection against theft and tampering since the equipment lies on a fastened base having fixed members limiting its movement in two axis and one or two U-shaped arms assembled to the base and retraining the movement of the equipment in the third axis. Those solutions still provide a very minimal restriction regarding the access to the rear panel and to the inside components of the equipment. Furthermore, they include no adjustment capability to receive equipments of various sizes and shapes.

OBJECTS OF THE INVENTION

The object of the present invention is to overcome the limitations and drawbacks of the above mentioned solutions of the prior art, and more specifically:

- a first object of the instant invention is to provide restriction of the equipment displacement along three axes with respect to the base;
- a second object of the present invention to provide an apparatus which prevents the integral theft of a protected equipment when the base is attached to a fixed element, for example through fastening to a work surface;
- a third object of the present invention is to prevent access to the inside components of the equipment from any face thereof, while maintaining access to the functional elements of the front, rear and side panels;
- a fourth object of the present invention is to provide a safety apparatus that is easily customer adaptable to a wide range of equipment sizes and shapes;

- another object of the present invention is to provide easy access to size adjustment members and work surface fastening means when the equipment is not in place, while efficiently preventing access to said members when the equipment is placed in the apparatus;
- a sixth object of the present invention is to provide a safety apparatus that permits to simultaneously lock and protect a video monitor placed on top of the equipment; and
- a further object of the present invention is to provide a safety apparatus that comprises a minimum number of parts, is aesthetical and economical to produce.

SUMMARY OF THE INVENTION

More specifically, in accordance with the present invention as broadly claimed, there is provided a security apparatus for preventing theft and/or tampering of an equipment or a part of the equipment, comprising a base member having a peripheral portion, an equipment-restraining assembly and a locking member. The equipment-restraining assembly comprises: first spaced apart portions for securing the equipment-restraining assembly to corresponding spaced apart points of the peripheral portion of the base member; second, third and fourth portions for extending along first, second and third generally vertical faces of the equipment, respectively, the second face being substantially opposite to the third face; and a fifth portion for extending along a fourth top face of the equipment. The locking member extends along a fifth generally vertical face of the equipment generally opposite to the first face, the locking member comprising a lock mechanism for removably locking the locking member to the base member.

Therefore, the equipment is confined within a space delimited by the base member, the second, third, fourth and fifth portions, and the locking member to thereby prevent theft and tampering of the equipment.

Also in accordance with the present invention, there is provided a security apparatus for preventing theft and/or tampering of an equipment or a part of the equipment, comprising:

(a) a base member having a peripheral portion;

(b) first and second elongated bent members each including:

- a first end section for securing the elongated bent member to a first point of the peripheral portion;
- a second end section for securing the elongated bent member to a second point of the peripheral portion spaced apart from the first point;
- a third section for extending along a rear face of the equipment;
- a fourth section for extending along a top face of the equipment; and
- the first and second elongated bent members further comprising respective fifth sections for extending along two opposite side faces of the equipment, respectively; and (c) at least one movement-restraining member for extending along a front face of the equipment, this movement-restraining member comprising a lock mechanism for removably locking the movement-restraining member to the base member.

In this manner, the equipment is confined within a space delimited by the base member, the first and second elongated bent members, and the at least one movement-restraining member to thereby prevent theft and tampering of the equipment.

In accordance with preferred embodiments:

the security apparatus further comprises fasteners for securing the first and second end sections of each elongated bent member to the first and second points of the peripheral portion, these securing fasteners being inaccessible when the equipment is confined within the above-mentioned space;

the security apparatus comprises a mechanical position-adjusting system interposed between the base member and the first and second end sections of each elongated bent member for adjusting the position of the first and second elongated members along three orthogonal axes, for thereby adapting the dimensions of the security apparatus to equipments of different sizes and shapes;

the base member comprises means for firmly attaching the base member to a vertical or horizontal supporting surface, or any other non transportable structure;

the security apparatus further comprises a drawer structure sliding on the base member between extended and retracted positions, wherein:

the drawer structure comprises a top face on which the equipment is placed, and a front face on which the locking member, including the lock mechanism are mounted;

in the retracted position of the drawer structure, the locking member extends along the fifth generally vertical face of the equipment;

the peripheral portion of the base member comprises a lock-receiving structure for receiving the lock mechanism in order to removably lock both the drawer structure and the locking member to the base member in order to confine the equipment within the space delimited by the base member, the second, third, fourth and fifth portions, and the locking member;

since the equipment is placed on the top face of the drawer structure, this equipment slides with the drawer structure; and in the extended position of the drawer structure, the drawer structure, the equipment-restraining assembly, and the locking member present a configuration defining a clearance sufficient for enabling use of the equipment.

Further in accordance with the present invention, there is provided a security apparatus for preventing theft and/or tampering of an equipment or a part of the equipment, comprising a base member, a first movement-restraining member, and a pivotal equipment-restraining assembly. The base member has a peripheral portion, and the first movement-restraining member is destined for being secured to the peripheral portion of the base member and for extending along a first generally vertical face of the equipment. The pivotal equipment-restraining assembly including first and second portions for pivotally connecting the equipment-restraining assembly on opposite sides of the peripheral portion of the base member, a third portion for extending along a second generally vertical face of the equipment, a fourth portion for extending along a third generally vertical face of the equipment generally opposite to the second face, a fifth portion for extending along a fourth top face of the equipment, a sixth portion for extending along a fifth generally vertical face of the equipment opposite to the first face, and a locking member connected to the sixth portion of the equipment-restraining assembly, this locking member comprising a lock mechanism for removably securing the locking member to the base member.

In this manner, the equipment is confined within a space delimited by the base member, the first movement-restraining member and the pivotal equipment-restraining assembly to prevent theft and tampering of the equipment.

Still further in accordance with the present invention, there is provided a security apparatus for preventing theft and/or tampering of an equipment or a part of the equipment, comprising a base member, a first movement-restraining member, and a pivotal equipment-restraining assembly. The base member has a peripheral portion, and the first movement-restraining member is destined for being secured to the peripheral portion of the base member and for extending along a first generally vertical face of the equipment. The pivotal equipment-restraining assembly comprises second and third elongated movement-restraining bent members and a locking member. The second elongated movement-restraining bent member includes a first portion for pivotally connecting the second bent member to the peripheral portion of the base member, a second portion for extending along a second generally vertical face of the equipment, a third portion for extending along a third top face of the equipment, and a fourth portion for extending along a fourth generally vertical face of the equipment opposite to the first face. The third elongated movement-restraining bent member includes a first portion for pivotally connecting the third elongated movement-restraining member to the peripheral portion of the base member, the first portions of the second and third bent members being pivotally connected on opposite sides of the peripheral portion of the base member, a second portion for extending along a fifth generally vertical face of the equipment generally opposite to the second face, a third portion for extending along the third top face of the equipment, and a fourth portion for extending along the fourth generally vertical face of the equipment. The locking member is connected to the fourth portions of the second and third elongated movement-restraining bent members, and comprises a lock mechanism for removably securing the locking member to the base member.

Again, the equipment is being confined within a space delimited by the base member, the first movement-restraining member, and the second and third elongated movement-restraining members to thereby prevent theft and tampering of the equipment.

Accordingly, the security apparatus restricts displacement of the equipment along three axes with respect to the base member to prevent integral theft of this equipment when the base member is attached to a fixed structure as well as to prevent access to the inside components of the equipment from any face thereof, but to maintain access to the functional elements of the front, rear and side panels of the equipment.

The objects, advantages and other features of the present invention will become more apparent upon reading of the following non restrictive description of preferred embodiments thereof, given for the purpose of exemplification only with reference to the accompanying drawings.

BRIEF DESCRIPTION OF THE DRAWINGS

In the appended drawings:

FIG. 9 is an isometric view of a second preferred embodiment of equipment security apparatus according to the present invention, protecting an equipment;

DETAILED DESCRIPTION OF THE PREFERRED EMBODIMENTS

First Preferred Embodiment

Figure 1:
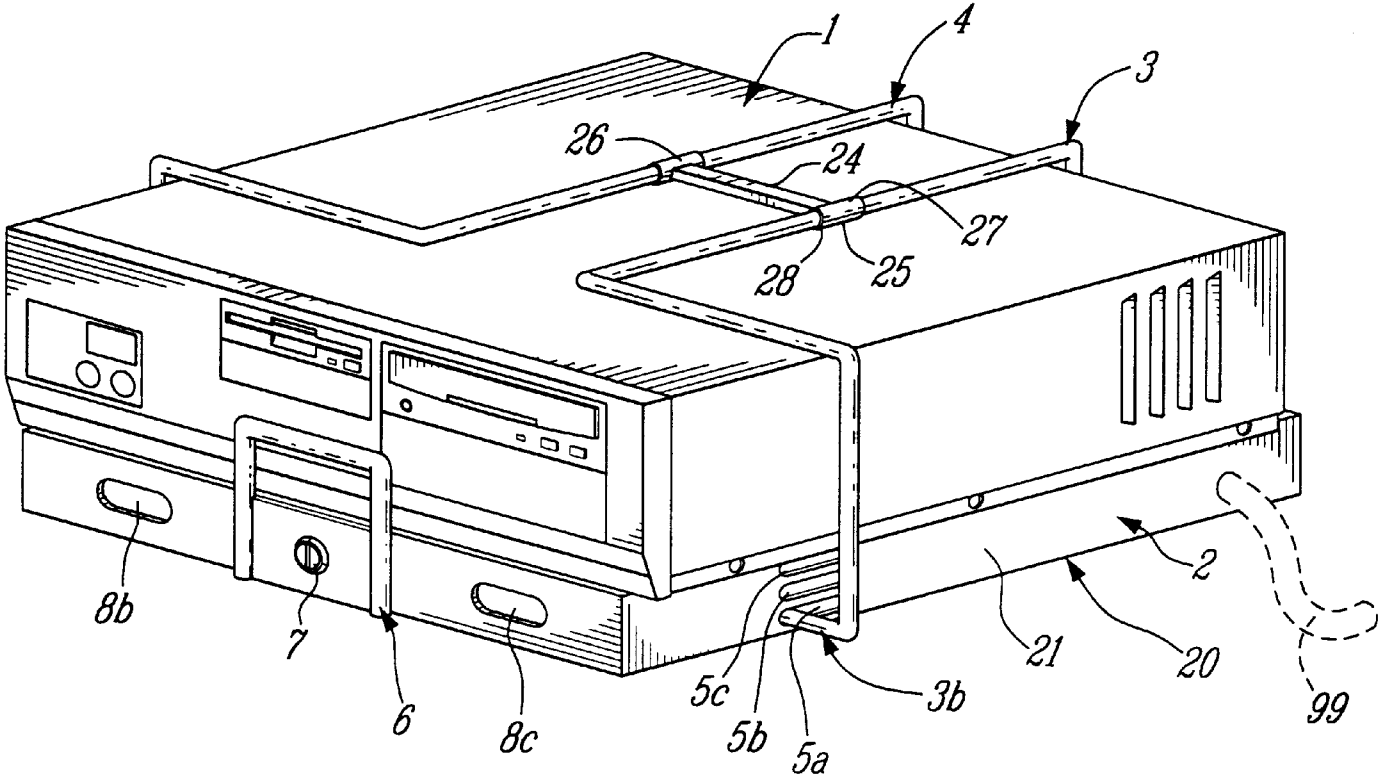
FIG. 1 is an isometric view of a first preferred embodiment of the equipment security apparatus according to the present invention, protecting an equipment.

This first preferred embodiment of the equipment security apparatus of the present invention will now be described with reference to FIGS. 1–8 the appended drawings.

In FIGS. 1–8 of the appended drawings, the same elements are identified by the same reference numerals.

Referring to FIGS. 1, 2, 3 and 5, the first preferred embodiment 20 of equipment security apparatus according to the present invention is illustrated. Apparatus 20 comprises a base member 2 on which an equipment 1 (a central processing unit of a computer in the illustrated example) is placed.

In the first preferred embodiment 20, the base member 2 defines a peripheral portion formed of four inverted U-shaped members 44, 45, 46 and 47 made of sheet metal cut and shaped as required. Each inverted U-shaped members 44, 45, 46 and 47 is formed with an inner flange such as 48 used to secure the base member 2 to a work surface.

In the illustrated example, the equipment 1 presents the general configuration of a parallelepiped. Of course, it is within the scope of the present invention to adapt the apparatus 20 to other equipment configurations.

Apparatus 20 further comprises elongated movement-restraining bent members constituted, in the preferred embodiment, by rods 3 and 4 having a generally circular cross section. A locking movement-restraining member 6 cooperates with the rods 3 and 4 to appropriately restrict movement of the equipment 1 in any direction with respect to the base member 2. As illustrated, locking member 6 comprises a key lock 7.

Figure 7:
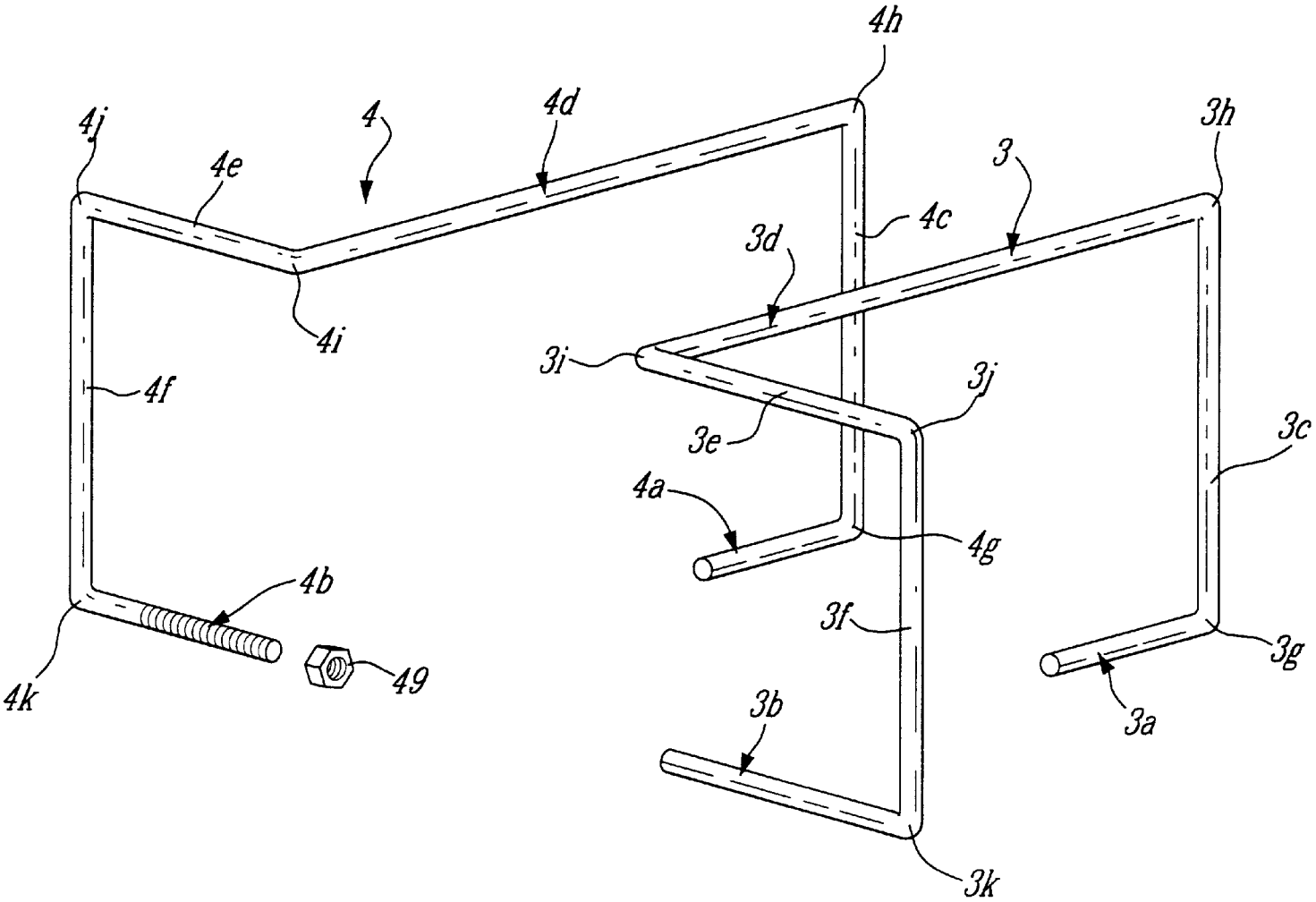
FIG. 7 is an isometric view of a pair of elongated movement-restraining bent members to be used in the first preferred embodiment of equipment security apparatus according to the invention.

Referring to FIG. 7, rod 3 comprises end sections 3*a* and 3*b*, rod sections 3*c*, 3*d*, 3*e* and 3*f*, and right angles 3*g*, 3*h*, 3*i*, 3*j* and 3*k*. End section 3*a* extends horizontally and rearwardly toward right angle 3*g*. Rod section 3*c* extends vertically and upwardly from right angle 3*g* to right angle 3*h*. Rod section 3*d* extends horizontally and forwardly from right angle 3*h* to right angle 3*i*. Rod section 3*e* extends horizontally toward the right from right angle 3*i* to right angle 3*j*. Rod section 3*f* extends vertically and downwardly from right angle 3*j* to right angle 3*k*. Finally, end section 3*b* extends horizontally toward the left from right angle 3*k*.

Still referring to FIG. 7, rod 4 comprises end sections 4*a* and 4*b*, rod sections 4*c*, 4*d*, 4*e* and 4*f*, and right angles 4*g*, 4*h*, 4*i*, 4*j* and 4*k*. Free end section 4*a* extends horizontally and rearwardly toward right angle 4*g*. Rod section 4*c* extends vertically and upwardly from right angle 4*g* to right angle 4*h*. Rod section 4*d* extends horizontally and forwardly from right angle 4*h* to right angle 4*i*. Rod section 4*e* extends horizontally toward the left from right angle 4*i* to right angle 4*j*. Rod section 4*f* extends vertically and downwardly from right angle 4*j* to right angle 4*k*. Finally, end section 4*b* extends horizontally toward the right from right angle 4*k*.

Therefore, each rod 3,4 is bent in such a manner that one of its free end sections 3*b*,4*b* can be secured to a side wall 21,22 of the base member 2 while the other free end section 3*a*,4*a* thereof can be secured to the rear wall 23 of the base member 2. Rod section 3*c*,4*c* of the rod 3,4 extends over the rear face of the equipment 1, rod sections 3*d*;4*d* and 3*e*;4*e* of the rod 3,4 extends over the top face of the equipment 1, rod section 3*f* of rod 3 and rod section 4*f* of rod 4 extend over the opposite side faces of the equipment 1, respectively. When the locking member 6 is installed, such an arrangement of the rods 3 and 4 prevents access to the interior of the equipment 1 and removal of inner parts from any side, and also restrains displacement of the equipment 1 along three orthogonal axis. Therefore, the safety apparatus 20 also prevents theft of the entire equipment 1 when the base member 2 is properly secured to the work surface or when any appropriate part of the apparatus 20 is connected to a fixed object through the use of steel cable 99 shown for example in FIG. 1.

Once the restraining bent rods 3 and 4 are secured to the base member 2, the equipment 1 can be inserted, that is slid in the apparatus 20 from the front and confined in the apparatus 20 by installing and locking the locking member 6. More specifically, the equipment 1 is confined within a space delimited by the base member 2, the movement-restraining bent rods 3 and 4 and the locking member 6 to prevent theft and tampering of the equipment 1.

Figure 2:
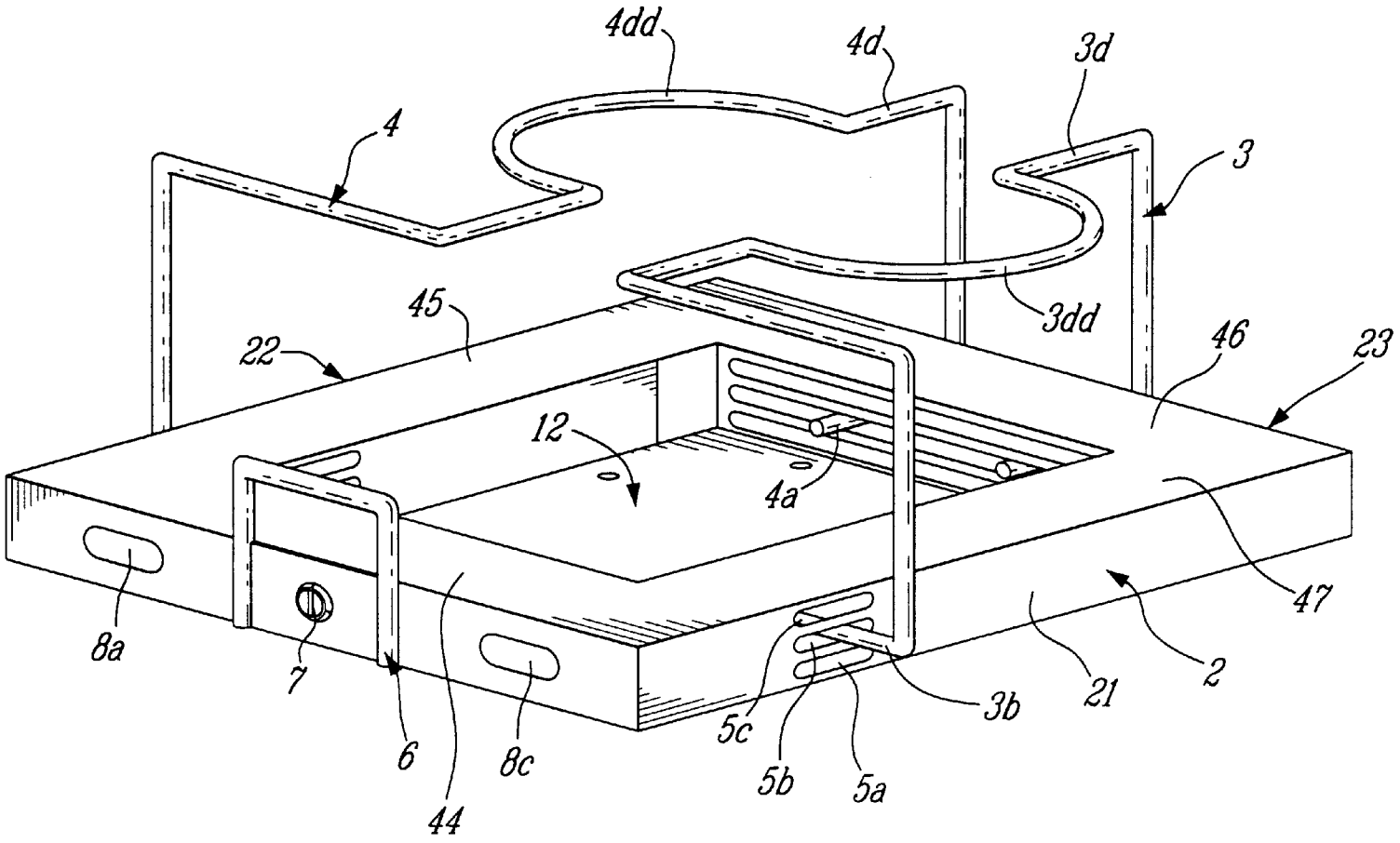
FIG. 2 is an isometric view of the first preferred embodiment without equipment.

Also, as illustrated in FIG. 2, the restraining bent rods 3 and 4 can optionally have their respective rod sections 3*d* and 4*d*, respectively formed with curved, for example semicircular portions 3*dd* and 4*dd*, in the place of linear rod sections 3*d* and 4*d*. The two curved portions 3*dd* and 4*dd* cooperate to form a nearly circular collar that can be used to hold the base of a video monitor (not shown) placed on top of the equipment 1 so as to simultaneously prevent theft of both pieces of equipment.

The top rod sections 3*d* and 4*d* of the restraining bent rod 3 and 4 can also be tied together through a bridging member 24 (FIG. 1) to make sure that one cannot spread these rod sections 3*d* and 4*d* apart by using sufficient force (especially in the case of a high equipment 1 requiring long rods more easily bendable) and thereby free the equipment 1. The bridging member 24 can be terminated by two bushings 25 and 26 at the two ends thereof, respectively, to slide along the rod sections 3*d* and 4*d*. Alternatively, each bushing can be formed of two semicylindrical upper and lower halves (see 27 and 28 for bushing 25), the two halves 27 and 28 being assembled together by means of fasteners (not shown) which are not accessible after the equipment is placed in the apparatus 20.

Figure 3:
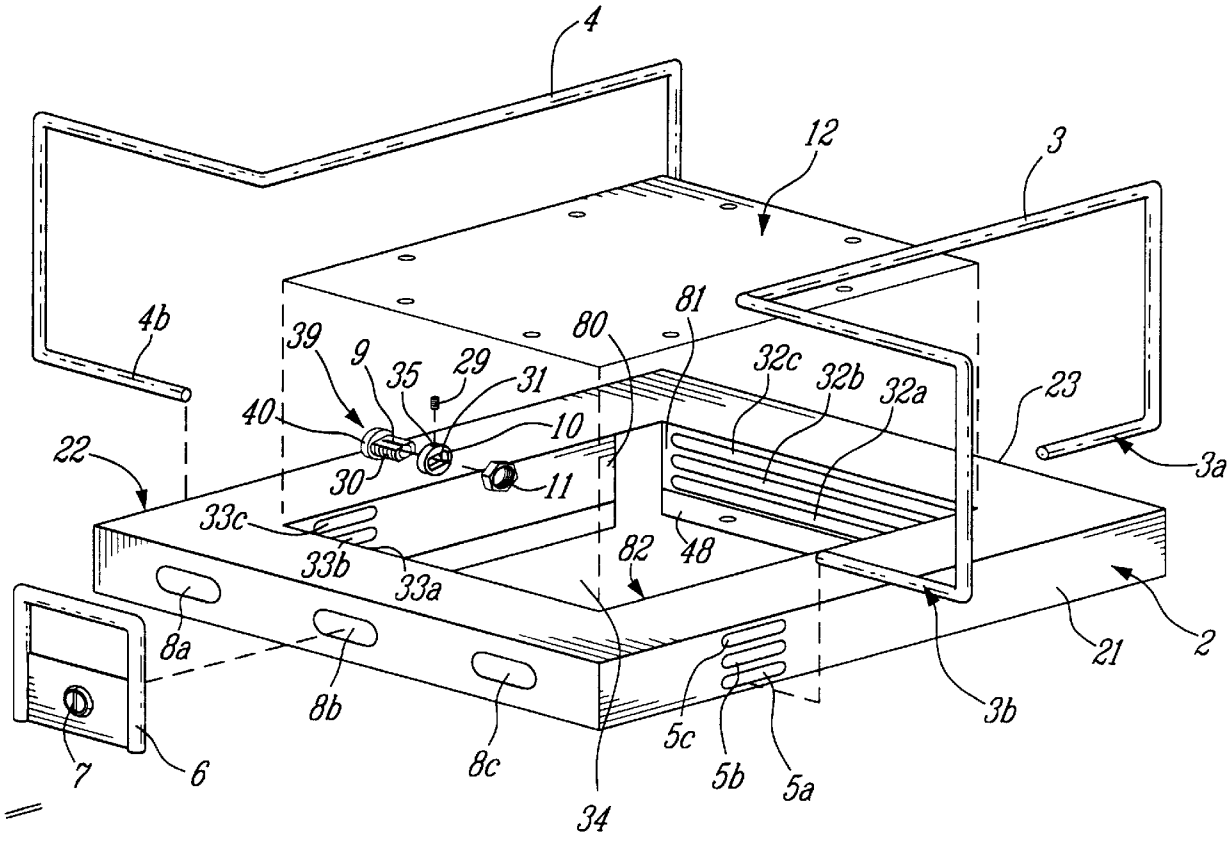
FIG. 3 is an isometric, exploded view of the first preferred embodiment of equipment security apparatus according to the invention, showing a base member, elongated movement-restraining bent members with end sections, and a first embodiment of bushing assembly for securing the end sections of the elongated members to the base member.
Figure 5:
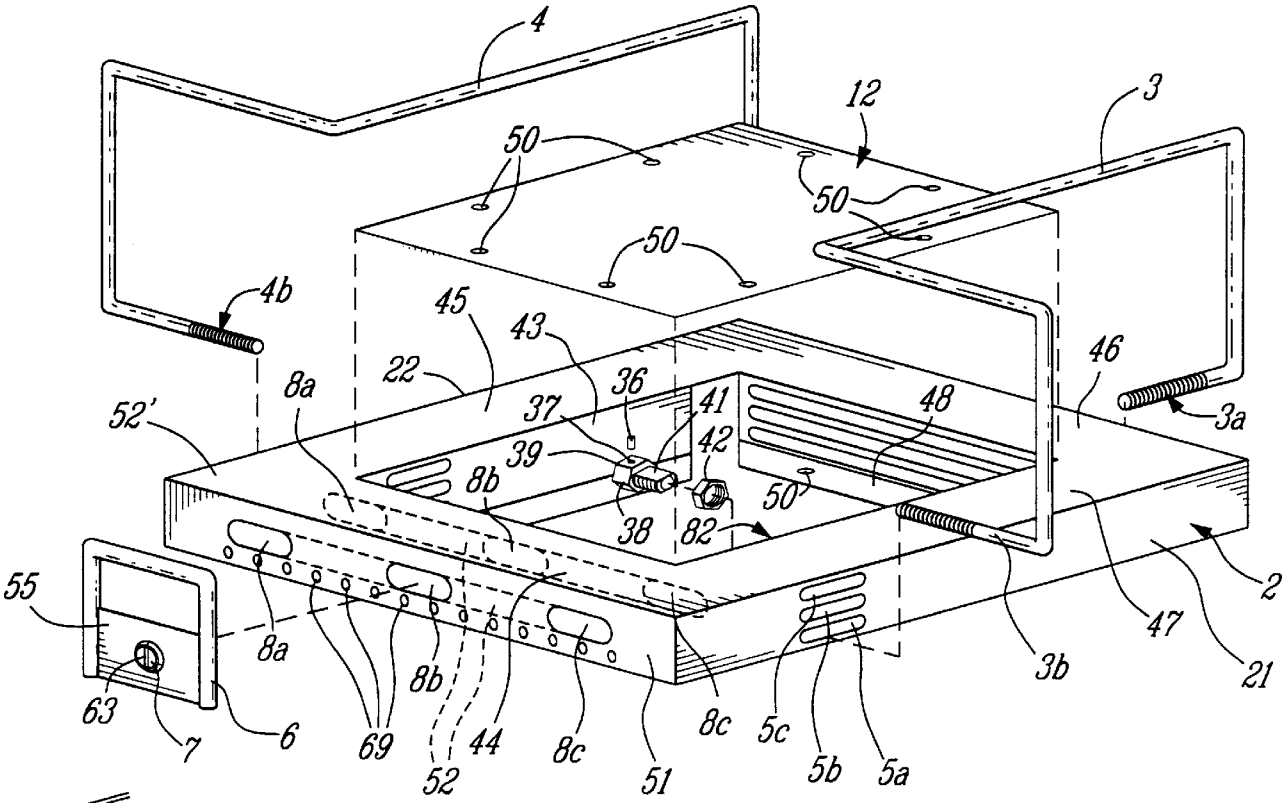
FIG. 5 is an isometric, exploded view of the first preferred embodiment of equipment security apparatus according to the invention, showing a second embodiment of bushing assembly for securing the end sections of the elongated members to the base member.

FIGS. 3 and 5 show systems for adjusting the dimensions of the equipment security apparatus 20 to the dimensions of the equipment 1 along three orthogonal axes. Each end section 3*a*, 3*b*, 4*a* and 4*b* of the rods 3 and 4 can be inserted in one slot of a respective set of elongated, superposed slots (set of slots 5*a*, 5*b*, 5*c* in side wall 21 for end section 3*b*, set of slots (not shown) in rear wall 23 for end sections 3*a* and 4*a*, and set of slots (not shown) in side wall 22 for free end section 4*b*) at the desired depth and locked in that position using a bushing assembly 39 provided with a set screw 29. Just a word to mention that in the inner walls 80, 81 and 82, corresponding sets of elongated superposed slots are provided. For example, set of superposed slots 32*a*, 32*b* and 32*c* are provided in inner wall 81 in alignment with the slots in the rear wall 23, and set of superposed slots 33*a*, 33*b* and 33*c* are provided in inner wall 80 in alignment with the slots in side wall 22. In the illustrated example, the end section 3*b* of the rod 3 is assembled to the base member 2 using the lowermost slot 5*a* on the left side wall 21 and the lowermost slot (not shown) in the inner wall 82 to match an equipment 1 of minimal height. The other free end sections 3*a*, 4*a* and 4*b* are also inserted in the corresponding lowermost slots in the corresponding walls of the base member 2. The length of the slots (for example 5*a*) in a pair of walls (for example side wall 21 and inner wall 82) receiving one free end section (for example 3*b*) determines the allowable stroke between minimum and maximum insertion depths of the other end (for, example 3*a*) of the rod (for example 3) in the slots (for example the lowermost slots including slot 32*a*) of the orthogonal walls (for example rear wall 23 and inner wall 81) of the base member 2. Reciprocally, in the same example, the depth of insertion of the free end section 3*b* in the slot 5*a* and the lowermost slot of inner wall 82 is limited by the length of the lowermost slots receiving the free end section 3*a* in the rear wall 23 and the inner wall 81. Of course, the same applies to rod 4, the free end sections 4*a* and 4*b*, the slots in side wall 22, inner wall 80, rear wall 23 and inner wall 81.

Figure 4:
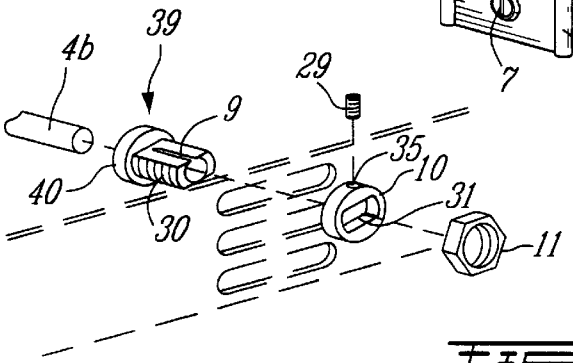
FIG. 4 is an enlarged view of the first embodiment of bushing assembly shown in FIG. 3.

The bushing assembly 39 shown in FIGS. 3 and 4 is provided with a bushing member 9 having a head portion 40 and a flat threaded portion 30 adapted to be inserted through a pair of aligned slots, for example the lowermost slot in side wall 22 and the lowermost slot 33*a* of inner wall 80 from the external side of the side wall 22. From the inner side of inner wall 80, a ring 10 having a slot 31 is inserted on the flat threaded portion 30 and a nut 11 is screwed onto the flat threaded portion 30. The end section 4*b* of rod 4 can then be inserted into the bushing member 9 and locked at the desired depth using the set screw 29 screwed into a threaded hole 35 of the slotted ring 10. The set screw 29 is screwed into the threaded hole 35 until the set screw 29 engages the rod section 4*b*. Of course similar bushings are used to secure the free end sections 3*a*, 3*b* and 4*a* in the corresponding slots of the walls 21 and 23.

Figure 6:
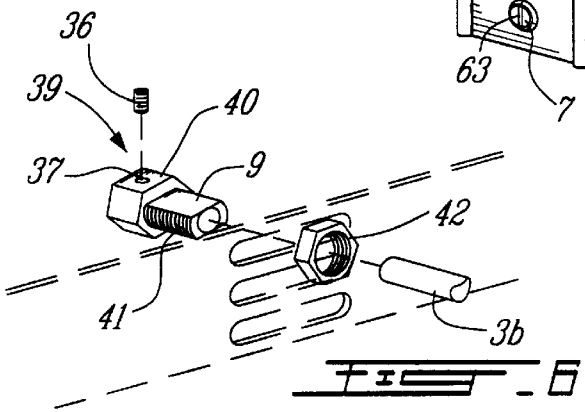
FIG. 6 is an enlarged view of the second embodiment of bushing assembly shown in FIG. 5.

FIGS. 5 and 6 show an alternative embodiment of the bushing assembly 39 in which the slotted ring 10 has been eliminated and the set screw 36 inserted in a threaded hole 37 provided in the head portion 38 of the bushing member 41. Although that alternate construction permits a cost reduction with respect to the preferred assembly, it presents the limitation of requiring the nut 42 to be installed between the outer wall (for example side wall 21) and internal wall (for example inner wall 82) of the base member 2, that space being accessible only from the underside of the base member 2. Therefore, that system requires to be installed before the base member 2 is fastened to a work surface.

An even more basic alternative system illustrated in FIG. 7 consists of threading the end sections of the rods 3 and 4. The threaded end sections 3*a*, 3*b*, 4*a* and 4*b* of the rods 3 and 4 (see FIG. 5 showing a threaded free end section 4*b*) receive respective nuts such as 49 from the inner side of the inner walls such as 80, 81 or 82, instead of a bushing assembly 39 provided with a set screw such as 29 or 36. Such a system has the drawback of enabling rotation of the rods 3 and 4 in the slots, thus resulting in a generally looser assembly. However, that limitation can be compensated by the installation of a second nut (not shown) firmly locked on the other side of the inner wall such as 80, 81 or 82, to the cost of limited accessibility.

An optional bottom plate 12 can be installed in the central area 34 of the base member 2. For example, the bottom plate 12 can be screwed to a work surface (not shown) along with the flanges such as 48 through holes such as 50. The base member 2 is therefore fastened to the work surface from that central area 34 which is not accessible when the equipment 1 is installed and locked in the equipment security apparatus 20. As provided in many solutions of the prior art, screws or double side adhesive tape can be used to firmly hold the bottom of the base member 2 on the work surface. It shall also be noted that the equipment 1 in its security apparatus 20 can be installed on a vertical surface as well as on an horizontal surface.

After the free end sections 3*a*, 3*b*, 4*a* and 4*b* of the rods 3 and 4 have been secured in the appropriate slots by means of the systems described in the foregoing description, and after the base member 2 has been secured to the work surface, the equipment 1 is slid into the apparatus 20 from the front thereof. The locking member 6 is then installed.

Locking member 6 can also be positioned at a plurality of positions on the front portion of the base member 2 using a plurality of holes or slots such as 8*a*, 8*b* and 8*c* or a unique very long slot 52 (shown in dashed lines), made either in the front wall 51 of the base member 2 or on the top wall 52 at the front of that base member 2. The purpose of this feature is to enable appropriate positioning of the locking member 6 so as not to interfere with normal operation of the equipment 1. Locking member 6 can be easily and rapidly removed or locked in place using key lock 7 to allow convenient insertion or removal of the equipment 1.

Figure 8:
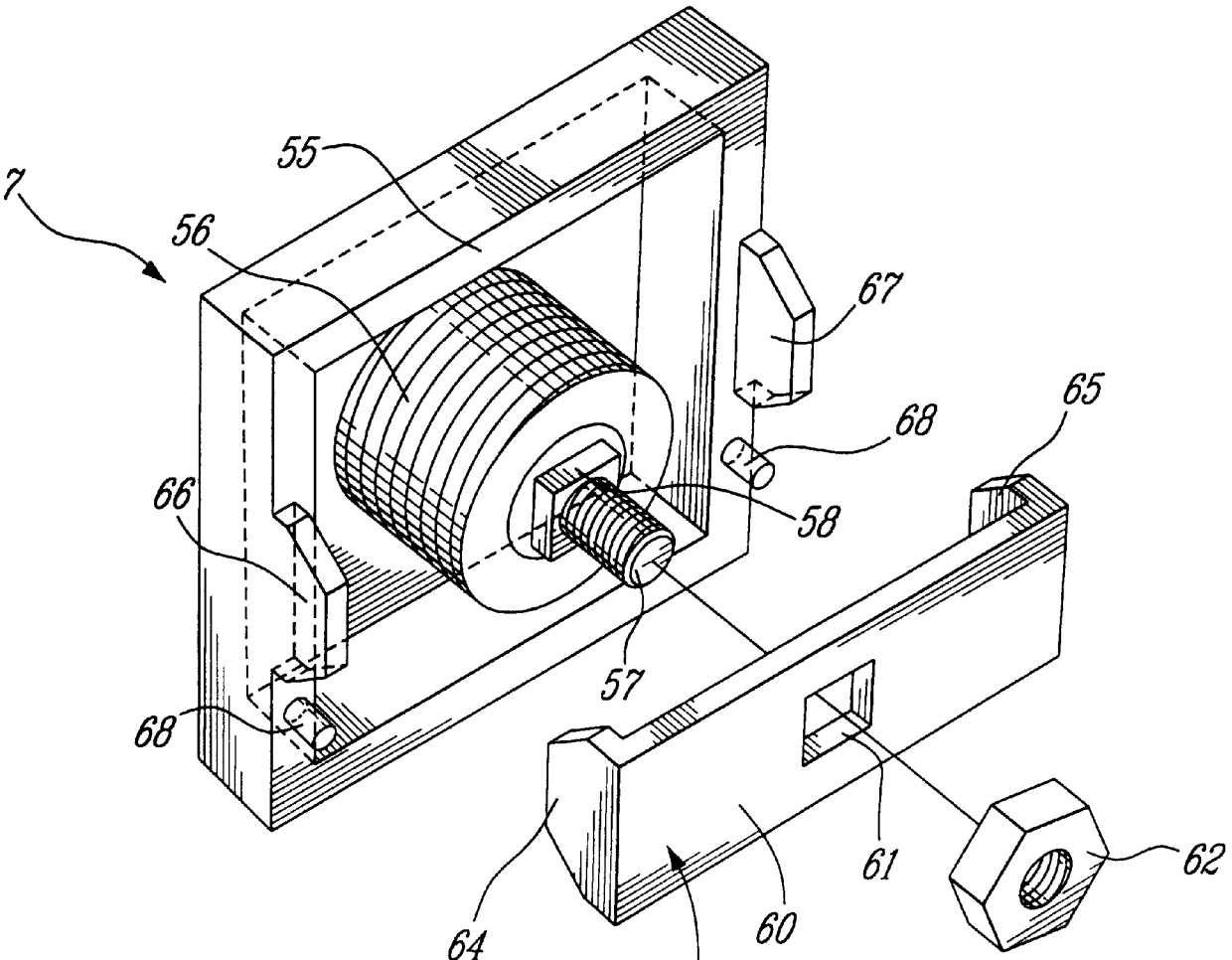
FIG. 8 is an isometric view of the locking mechanism of a locking movement-restraining member of the first embodiment of equipment security apparatus as shown in FIGS. 3 and 5.
Figure 6:
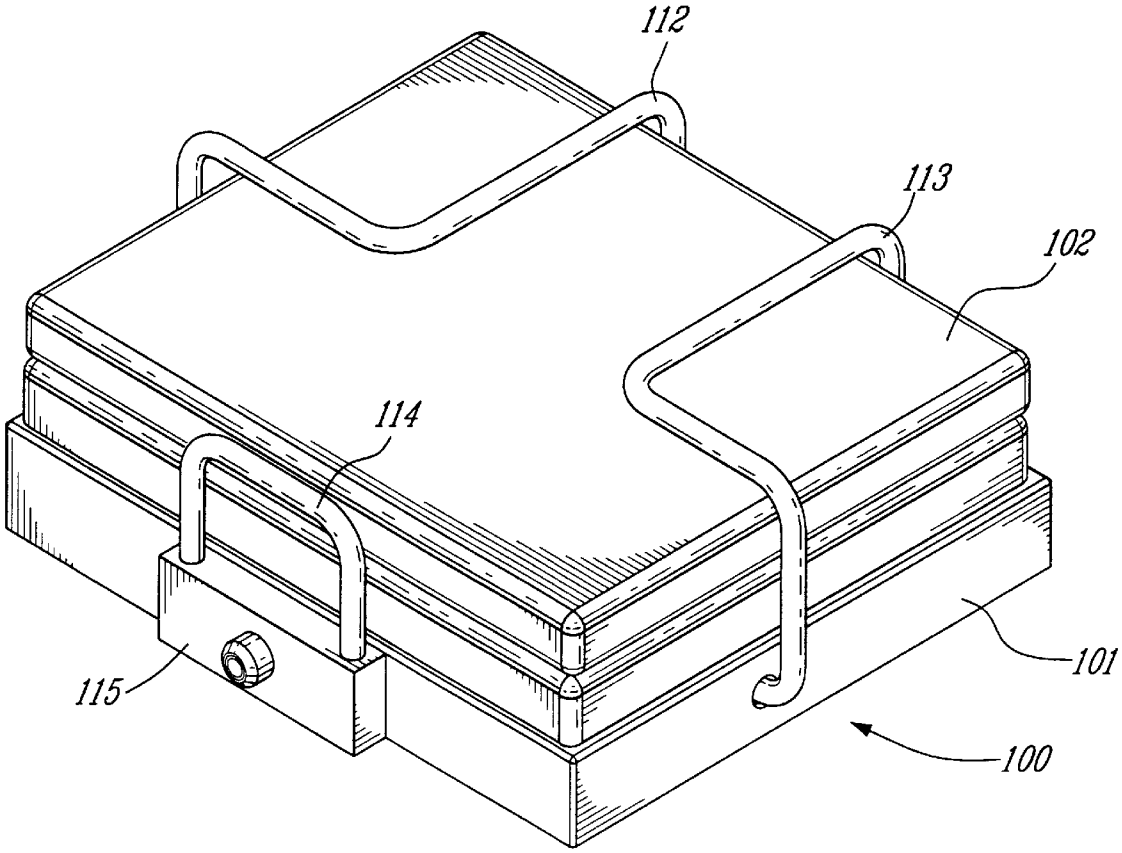

As illustrated in FIG. 8, the key lock 7 comprises a plate 55 to be fixed to the locking member 6 as shown in FIGS. 3 and 5. Fixedly mounted on the rear face of the plate 55 is a key-operated cylinder 56 having an axial threaded pin 57 with a square base 58. Also formed on the rear face of the plate 55 are trapezoidal plate members 66 and 67.

Pin 57 can be rotated by means of a key (not shown) in keyhole 63 (FIGS. 3 and 4). A U-shaped latch 59 comprises a central bar 60 provided with a central square hole 61 to be placed onto the square base 58. A nut 62 is then screwed on the threaded pin 57 to retain the central hole 61 on the square base 58 whereby rotation of the pin 57 by means of the key will cause rotation of the latch 59. The opposite ends of the central bar 60 of the latch 59 are finally formed with respective right-angle short arms 64 and 65 extending toward the plate 55 and having rounded free ends.

In operation, the latch 59 is aligned on the trapezoidal plate members 66 and 67 and inserted in one slot such as 8*a*, 8*b*, 8*c* or 52. The key is then inserted in keyhole 63 and the pin 57 is rotated to position the latch 59 at right angle with respect to the slot 8*a*, 8*b*, 8*c* or 52. The key is removed from keyhole 63 and the locking member 6 is then locked in position to prevent any forward sliding of the equipment 1.

After the latch 59 has been positioned at right angle with respect to the slot 8*a*, 8*b*, 8*c* or 52, the rounded free ends of the arms 64 and 65 are applied to the rear face of the front wall 51 to prevent removal of the key lock 7. Also, the trapezoidal plate members 66 and 67 are then inserted in the slot 8*a*, 8*b*, 8*c* or 52 to prevent rotation of the key lock in this slot.

In the case of the unique very long slot 52, the rear face of the plate 55 is provided with pins such as 68 and the front wall 51 of the base member 2 is provided with a series of holes such as 69 to receive the pins 68 and therefore prevent longitudinal movement of the locking member 6 in the unique very long slot 52.

As can be appreciated, the key lock 7 can be placed in any of the slots 8*a*, 8*b* and 8*c* and in any position along the slot 52 to avoid interference of the locking member 6 with normal operation of the equipment 1.

Alternatively, the locking member 6 can be replaced by any equivalent device, for example two or more locking pins or U-shaped members inserted in holes in the front wall 51 of the base member 2, these pins or U-shaped members being locked and unlocked by means of a locking mechanism inside the base member 2 and activated by a key lock on one side of the base through an action similar to the one of a padlock.

Although the preferred embodiment of the present invention as described in the foregoing description uses rods each having two free end sections respectively secured to side and rear walls of the base member, it is within the scope of the present invention to design other configurations of rods having two free end sections secured either to many rear and side walls or to a single side or rear wall. It is also within the scope of the present invention to replace the key lock 7 by another type of lock, for example a combination lock (not shown).

Second Preferred Embodiment

FIG. 9 of the appended drawings illustrates this second preferred embodiment 100 of the equipment security apparatus according to the present invention. Apparatus 100 comprises a base member 101 on which an equipment 102 (laptop computer in the illustrated example) is placed.

In the illustrated example, the equipment 1 presents the general configuration of a parallelepiped. Of course, it is within the scope of the present invention to adapt the apparatus 100 to other equipment configurations.

Figure 10:
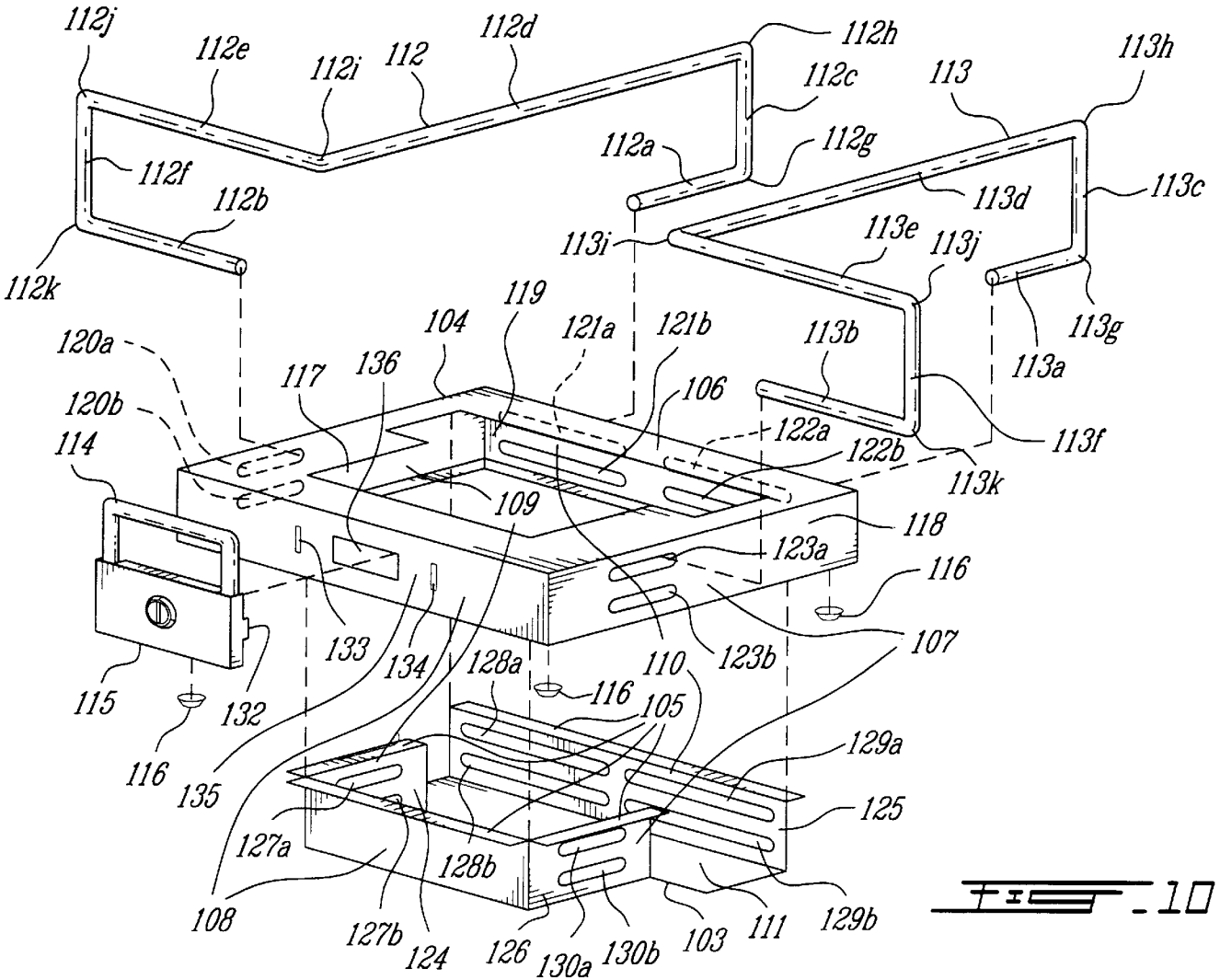
FIG. 10 is an isometric, exploded view of the second preferred embodiment of equipment security apparatus according to the invention, showing a base member, and elongated movement-restraining bent members.

Referring to FIG. 10, base member 101 comprises inner and outer portions 103 and 104. Both portions 103 and 104 are made of sheet metal cut and shaped as required Inner portion 103 comprises a top outwardly extending flange 105 spot welded to the underside of a top wall 106 of the outer portion 104. Inner and outer portions 103 and 104 defines a rectangular base member 101 formed of four inverted U-shaped members 107, 108, 109 and 110. The inner portion 103 is formed with a bottom wall 111 that can be screwed to, for example, the top face of a work surface such as a table.

Four corner plastic bumpers such as 116 are adhered to the underside of the base member 101 for smooth contact with the work surface.

Apparatus 100 further comprises elongated movement-restraining bent members constituted, in the preferred embodiment, by rods 112 and 113 having a generally circular cross section. A locking movement-restraining member 114 cooperates with the rods 112 and 113 to appropriately restrict, as illustrated in FIG. 9, movement of the equipment 102 in any direction with respect to the base member 101. As illustrated, locking member 114 comprises a key lock 115.

Referring to FIG. 10, rod 112 comprises end sections 112*a* and 112*b*, rod sections 112*c*, 112*d*, 112*e* and 112*f*, and right angles 112*g*, 112*h*, 112*i*, 112*j* and 112*k*. End section 112*a* extends horizontally and rearwardly toward right angle 112*g*. Rod section 112*c* extends vertically and upwardly from right angle 112*g* to right angle 112*h*. Rod section 112*d* extends horizontally and forwardly from right angle 112*h* to right angle 112*i*. Rod section 112*e* extends horizontally toward the left from right angle 112*i* to right angle 112*j*. Rod section 112*f* extends vertically and downwardly from right angle 112*j* to right angle 112*k*. Finally, end section 112*b* extends horizontally toward the right from right angle 112*k*.

Still referring to FIG. 10, rod 113 comprises end sections 113*a* and 113*b*, rod sections 113*c*,113*d*,113*e* and 113*f*, and right angles 113*g*, 113*h*, 113*i*, 113*j* and 113*k*. Free end section 113*a* extends horizontally and rearwardly toward right angle 113*g*. Rod section 113*c* extends vertically and upwardly from right angle 113*g* to right angle 113*h*. Rod section 113*d* extends horizontally and forwardly from right angle 113*h* to right angle 113*i*. Rod section 113*e* extends horizontally toward the right from right angle 113*i* to right angle 113*j*. Rod section 113*f* extends vertically and downwardly from right angle 113*j* to right angle 113*k*. Finally, end section 113*b* extends horizontally toward the left from right angle 113*k*.

Therefore, each rod 112,113 is bent in such a manner that one of its free end sections 112*b*,113*b* can be secured to a side wall 117,118 of the base member 101 while the other free end section 112*a*,113*a* thereof can be secured to the rear wall 119 of the base member 101. Rod section 112*c*,113*c* of the rod 112,113 extends over the rear face of the equipment 102, rod sections 112*d*;112*d* and 112*e*;113*e* of the rod 112,113 extends over the top face of the equipment 102, rod section 112*f* of rod 112 and rod section 113*f* of rod 113 extend over the opposite side faces of the equipment 102, respectively. When the locking member 114 is installed, such an arrangement of the rods 112 and 113 prevents access to the interior of the equipment 102 and therefor removal and theft of inner parts from any side. As can be appreciated, displacement of the equipment 102 along the three orthogonal axis is prevented. The safety apparatus 100 also prevents theft of the entire equipment 1 when the base member 101 is properly secured to the work surface or when any appropriate part of the apparatus 100 or base member 101 is connected to a fixed object through the use of steel cable (not shown).

Once the restraining bent rods 112 and 113 are secured to the base member 101, the equipment 102 can be inserted, that is slid in the apparatus 100 from the front and confined in the apparatus 100 by installing and locking the locking member 114. More specifically, the equipment 102 is confined within a space delimited by the base member 101, the movement-restraining bent rods 112 and 113 and the locking member 114 to prevent theft and tampering of the equipment 102.

In the example of FIG. 10, each end section 112*a*, 112*b*, 113*a* and 113*b* of the rods 112 and 113 can be inserted in one slot of a respective set of elongated, superposed slots (set of slots 120*a*, 120*b* in side wall 117 for end section 112*b*, set of slots 121*a*,121*b* in rear wall 119 for end sections 112*a*, set of slots 122*a*,122*b* in rear wall 119 for end section 113*a* , and set of slots 123*a*,123*b* in side wall 118 for free end section 113*b*). It is worth to be mentioned here that in the inner walls 124, 125 and 126 of inner portion 103, corresponding sets of elongated superposed slots are provided. For example, set of superposed slots 127*a* and 127*b* are provided in inner side wall 124 in alignment with the slots 120*a* and 120*b* in outer side wall 117, set of superposed slots 128*a* and 128*b* are provided in rear inner wall 125 in alignment with the slots 121*a* and 121*b* in the outer rear wall 119, set of superposed slots 129*a* and 129*b* are provided in inner rear wall 125 in alignment with the slots 122*a* and 122*b* in the outer rear wall 119, and set of superposed slots 130*a* and 130*b* are provided in inner side wall 126 in alignment with the slots 123*a* and 123*b* in the outer side wall 118. The free end sections 112*a*, 112*b*, 113*a* and 113*b* of the rods are mounted in the lowermost slots 121*b*, 120*b*, 122*b* and 123*b* of the base member 101, respectively to match an equipment 102 of minimal height. In the same manner, the free end sections 112*a*, 112*b*, 113*a* and 113*b* of the rods are mounted in the uppermost slots 121*a*, 120*a*, 122*a* and 123*a* of the base member 101, respectively, to match a higher equipment 102. The length of the slots 120*a*, 120*b*, 127*a*, 127*b*, 123*a*, 123*b*, 130*a* and 130*b* determines the allowable stroke between minimum and maximum insertion depths of the free end sections 112*a* and 113*a* in the respective slots 121*a*, 121*b*, 128*a*, 128*b*, 122*a*, 122*b*, 129*a* and 129*b*. Reciprocally, the depth of insertion of the free end section 112*b* in the slots 120*a*, 120*b* , 127*a* and 127*b* is limited by the length of the slots 121*a*, 121*b*, 128*a* and 128*b*. Finally, the depth of insertion of the free end section 113*b* in the slots 123*a*, 123*b*, 130*a* and 130*b* is limited by the length of the slots 122*a*, 122*b*, 129*a* and 129*b*.

The end sections 112*a*, 112*b*, 113*a* and 113*b* can be mounted in the respective slots of the walls 117;124, 118;126 and 119;125 through bushing assemblies such as 39 described in the foregoing description in relation to FIGS. 3–6.

Figure 11:
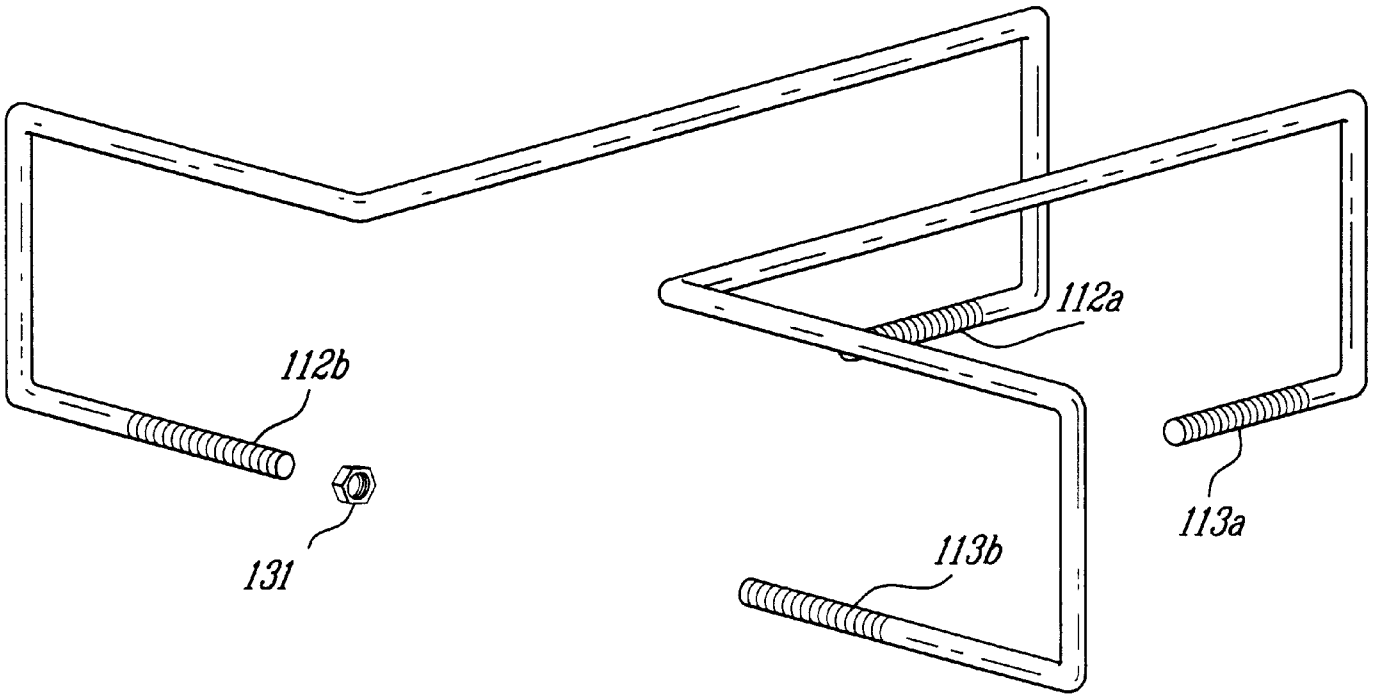
FIG. 11 is an isometric view of a pair of elongated movement-restraining bent members to be used in the second preferred embodiment of equipment security apparatus as shown in FIGS. 9 and 10.

An even more basic alternative system illustrated in FIG. 11 consists of threading the end sections 112*a*, 112*b*, 113*a* and 113*b* of the rods 112 and 113. The threaded end sections 112*a*, 112*b*, 113*a* and 113*b* (see FIG. 11 showing a threaded free end section 112*b*) receive respective nuts such as 131 from the inner side of the inner walls such as 124, 125 or 126, instead of a bushing assembly 39 provided with a set screw such as 29 or 36 Such a system has the drawback of enabling movement of the rods 3 and 4 in the slots, thus resulting in a generally looser assembly. However, that limitation can be compensated by the installation of a second nut (not shown) firmly locked on the other side of the inner wall such as 124, 125 or 126, to the cost of limited accessibility.

As indicated in the foregoing description, the bottom wall 111 can be screwed to a work surface (not shown). The base member 101 is therefore fastened to the work surface from that bottom wall 111 which is not accessible when the equipment 102 is installed and locked in the equipment security apparatus 100. As provided in many solutions of the prior art, screws or double side adhesive tape can be used to firmly hold the bottom of the base member 101 on the work surface. It shall also be noted that the equipment 102 in its security apparatus 101 can be installed on a vertical surface as well as on an horizontal surface.

After the free end sections 112*a*, 112*b*, 113*a* and 113*b* of the rods 112 and 113 have been secured in the appropriate slots by means of the systems described hereinabove, and after the base member 101 has been secured to the work surface, the equipment 102 is slid into the apparatus 101 from the front thereof. The locking member 114 is then installed. Locking member 114 can be easily and rapidly removed or locked in place using key lock 115 to allow convenient insertion or removal of the equipment 102.

Key lock 115 comprises a pair to tabs such as 132 to be inserted in a pair of vertical slots 133 and 134, respectively, of a front wall 135 of the base member 101. Otherwise, key lock 115 can be identical to key lock 7 illustrated in FIG. 8. As can be appreciated, latch 59 is inserted in a rectangular opening 136.

Third Preferred Embodiment

Figure 13:
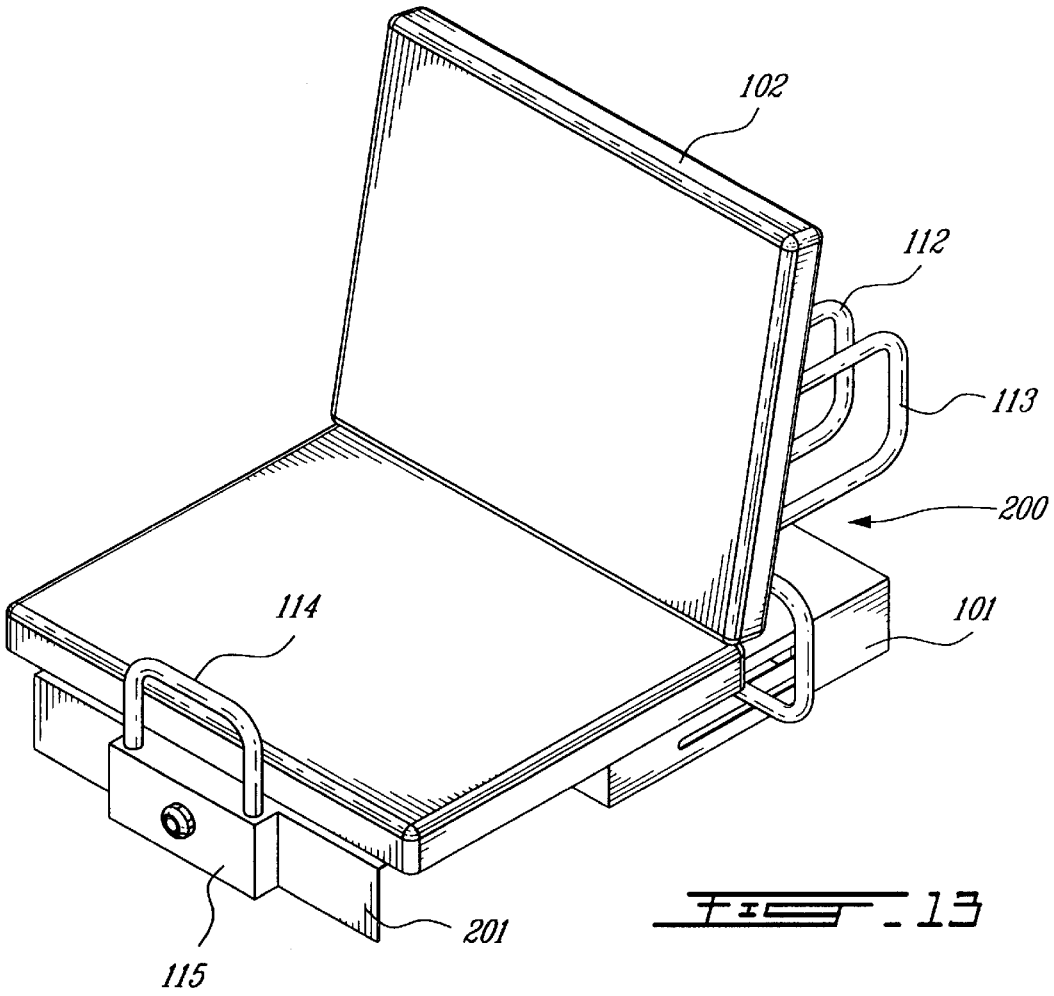
FIG. 13 is an isometric view of the third preferred embodiment of equipment security apparatus as shown in FIG. 12.
Figure 12:
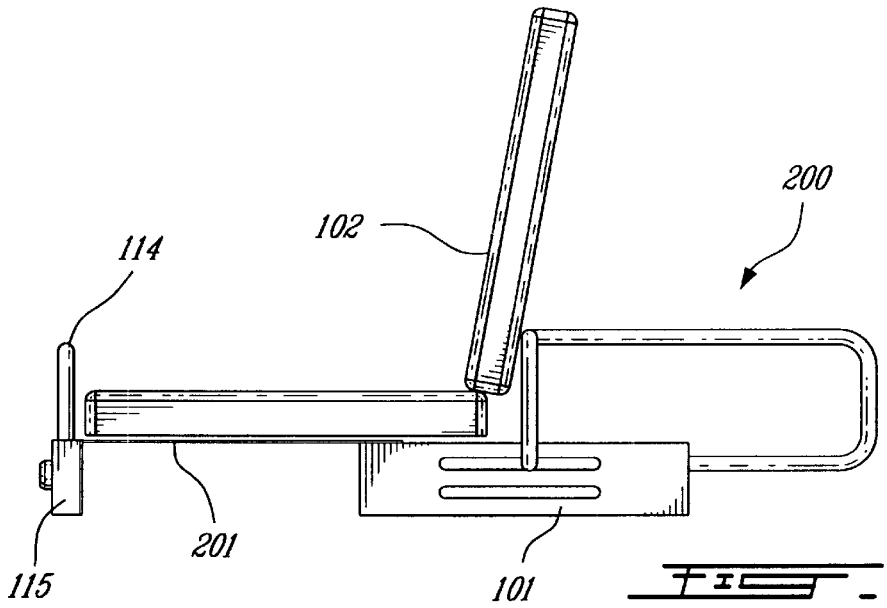
FIG. 12 is a side elevational view of a third preferred embodiment of equipment security apparatus according to the present invention, incorporating a drawer structure on which the equipment is placed.
Figure 14:
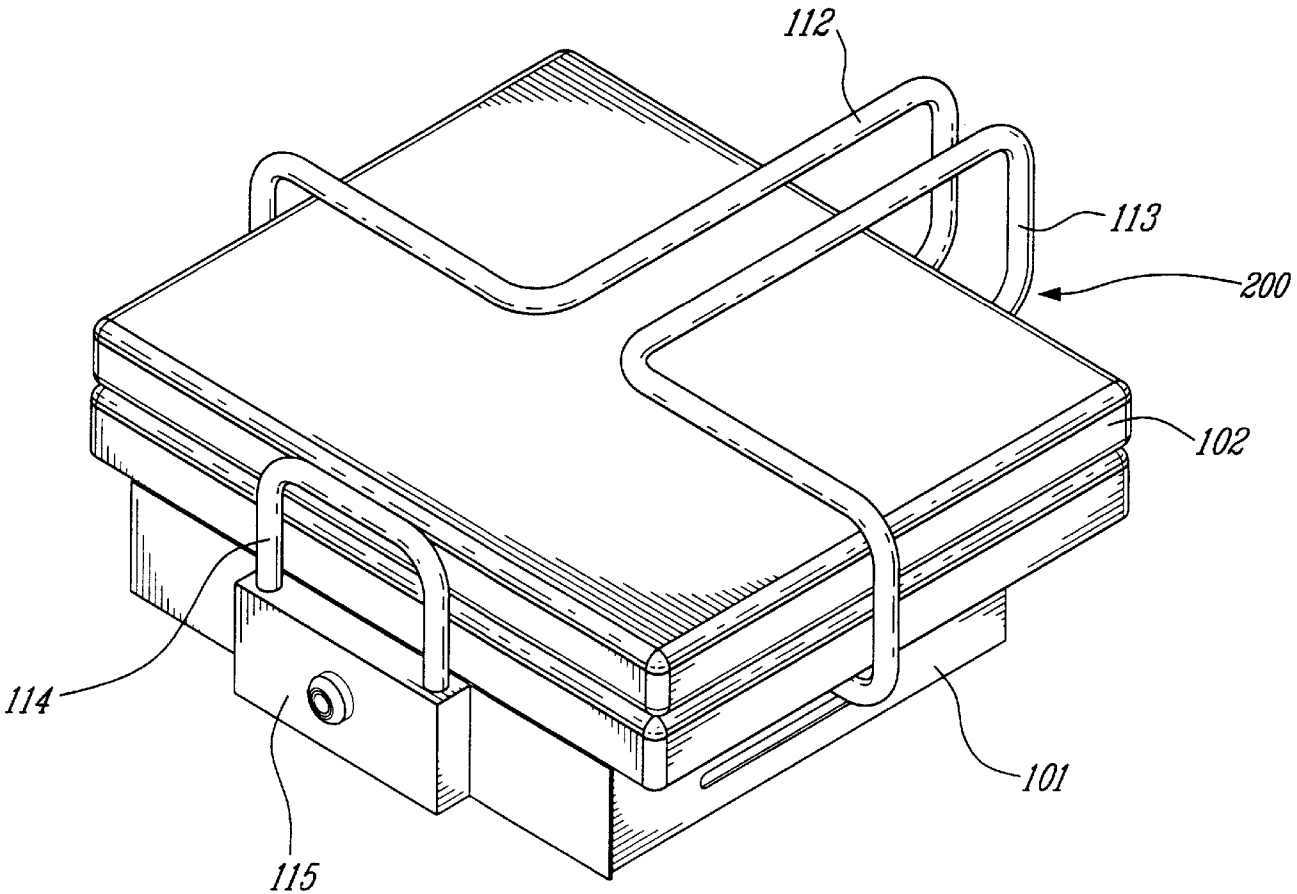
FIG. 14 is an isometric view of the third preferred embodiment of equipment security apparatus according to the present invention, protecting an equipment.

FIGS. 12–14 of the appended drawings illustrates a third preferred embodiment 200 of the equipment security apparatus according to the present invention.

Equipment security apparatus 200 is similar to apparatus 100. The difference is that the locking member 114 is mounted on the front face of a drawer structure 201 slidably mounted on the base member 101 on which the equipment 102 (laptop computer in the illustrated example) is placed. Key lock 115 is used to lock the drawer structure 201 in retracted position. Key lock 115 still cooperates with the front wall 135 of the base member 101 to lock the drawer structure 201 in retracted position as described in relation to FIG. 10.

In operation, the locking member 114 is unlocked through the key lock 115, the drawer structure 201 is extended and, finally, the equipment 102 is positioned on this drawer structure 201.

In the extended position of the drawer structure 201, the equipment 102 (laptop computer) can be unfolded and used as illustrated in FIGS. 12 and 13.

After use, the laptop computer 102 can be folded and the drawer structure 201 retracted and finally locked in the retracted position by means of key lock 115. The lap top computer 102 is then confined within a space delimited by base member 101, the drawer structure 201, the pair of rods 112 and 113 and the locking member 114 as illustrated in FIG. 14 to prevent theft and tampering of the equipment 102. Since the base member 101 is secured to a surrounding structure (not shown), theft of the equipment 102 is prevented.

Fourth Preferred Embodiment

Figure 16:
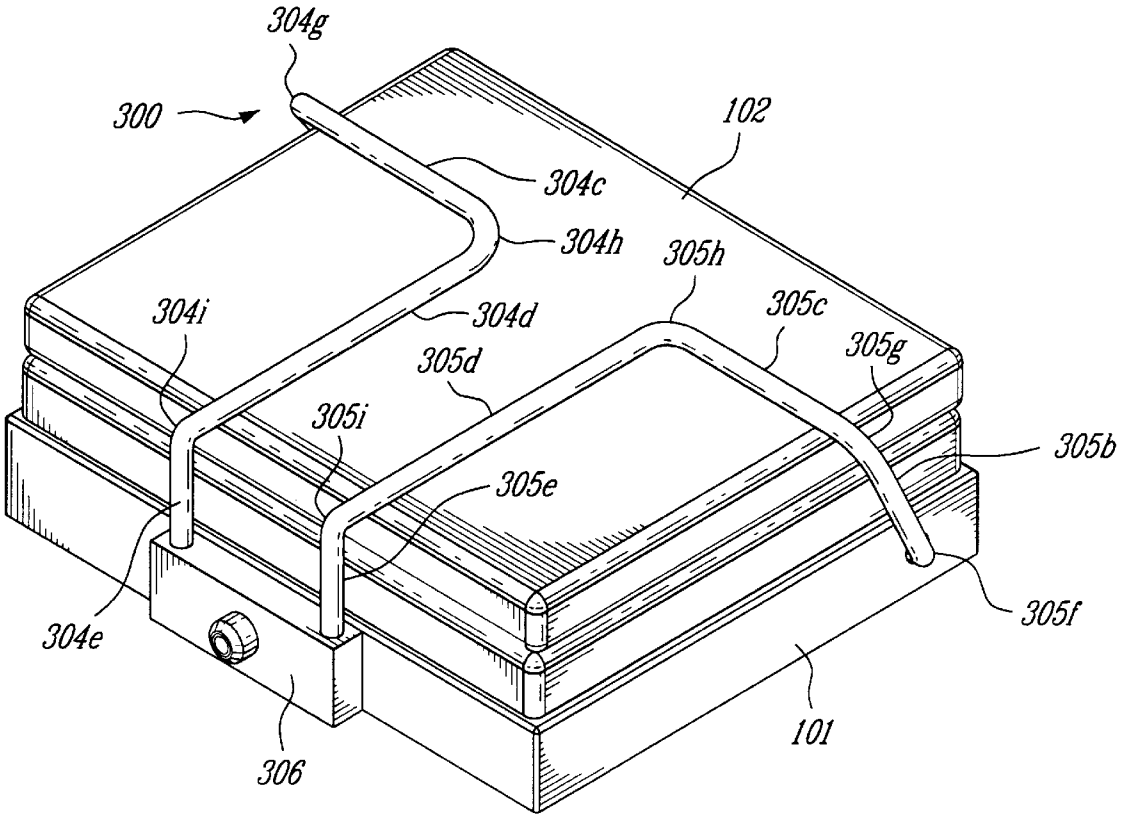
FIG. 16 is an isometric view of the fourth preferred embodiment of equipment security apparatus according to the present invention, protecting an equipment.

In this fourth preferred embodiment 300, the equipment 102 and the base member 101 have substantially the same horizontal cross section (see FIG. 16). Base member 101 has substantially the same structure as described in relation to FIG. 10.

A U-shaped vertically extending movement-restraining rod member 301 is mounted to the rear wall 119 of the base member 101. Rod member 301 is preferably made of steel. This U-shaped vertically extending rod member 301 comprises, for that purpose, a pair of horizontal end rod sections 302 and 303 mounted to the rear wall 119 as described in relation to FIGS. 10 and 11 of the appended drawings.

The security equipment apparatus 300 further comprises a pair of elongated movement-restraining bent members constituted, in the preferred embodiment, by rods 304 and 305 preferably made of steel and having a generally circular cross section.

Figure 15:
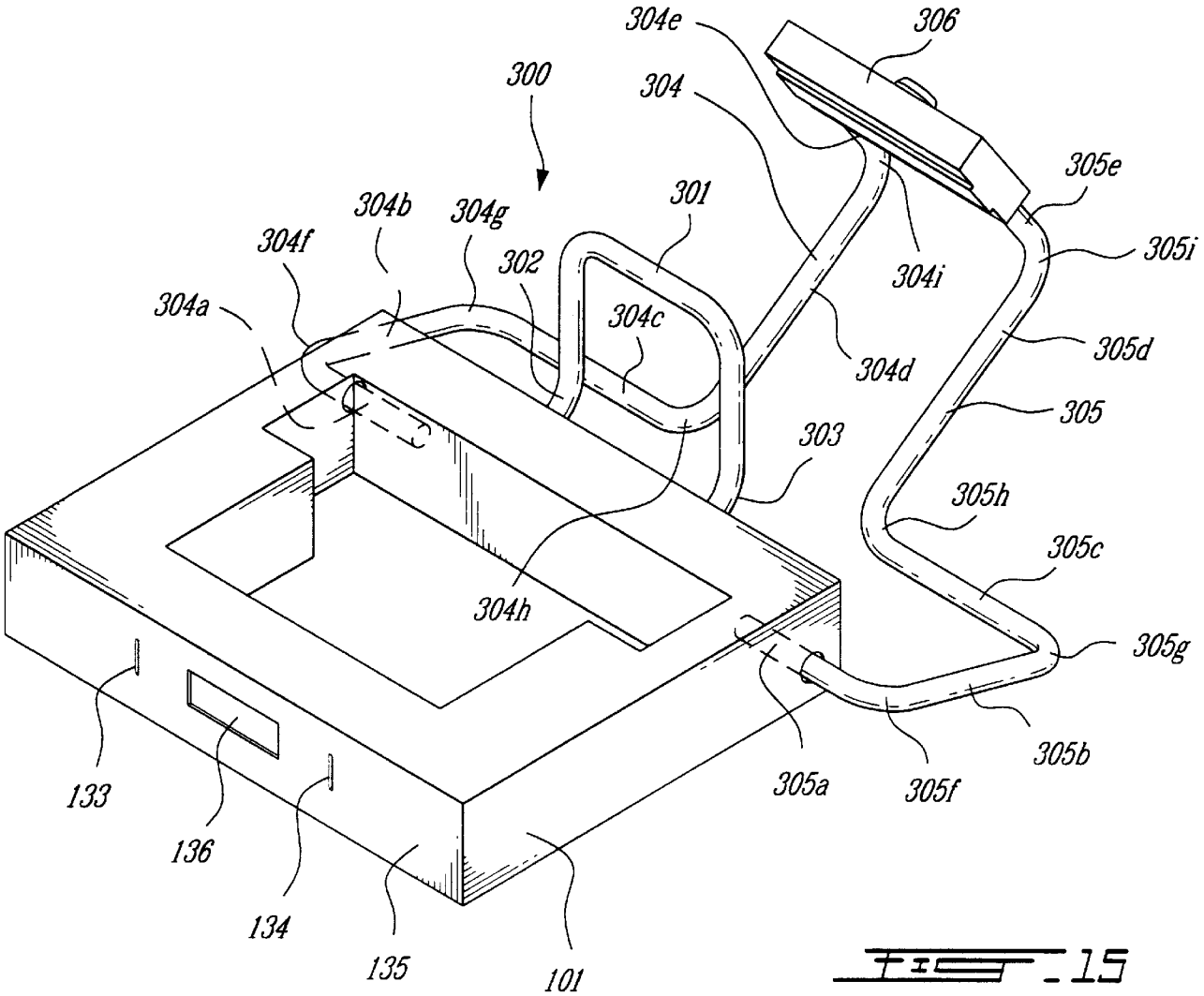
FIG. 15 is an isometric view of the fourth preferred embodiment of equipment security apparatus according to the invention, without equipment and comprising a pair of pivotal, elongated equipment-restraining rod members.

Referring to FIG. 15, rod 304 comprises end rod sections 304*a*, rod sections 304*b*, 304*c*, 304*d* and 304*e*, right angles 304*f*, 304*g*, 304*h*, and 304*i*.

End section 304*a* extends horizontally from right angle 304*f* into coaxial circular holes (not shown) in the walls 117 and 124 of the base member 101. End section 304*a* can be threaded and locked in these circular holes by means of a nut such as 131 as shown in FIG. 11. This will enable rotation of the end rod section 304*a* in the coaxial holes.

Rod section 304*b* extends in a vertical plane from right angle 304*f* to right angle 304*g*; in the locked position of FIG. 16, rod section 304*b* extends adjacent the corresponding side of the base member 101 and equipment 102. Still in the locked position of FIG. 16, rod section 304*c* extends horizontally and inwardly from right angle 304*g* to right angle 304*h* over the top face of equipment 102. Rod section 304*d* extends horizontally and forwardly over the top face of equipment 102 from right angle 304*h* to right angle 304*i*. Rod section 304*e* extends vertically and downwardly from right angle 304*i* to key lock 306 adjacent the front side of equipment 102 and the front wall 135 of base member 101.

Referring to FIG. 15, rod 305 comprises end rod sections 305*a*, rod sections 305*b*, 305*c* , 305*d* and 305*e*, right angles 305*f*, 305*g*, 305*h*, and 305*i*.

End section 305*a* extends horizontally from right angle 305*f* into coaxial circular holes (not shown) in the walls 118 and 126 of the base member 101. End section 305*a* can be threaded and locked in these circular holes by means of a nut such as 131 as shown in FIG. 11. This will enable rotation of the end rod section 305*a* in the coaxial holes.

Rod section 305*b* extends in a vertical plane from right angle 305*f* to right angle 305*g*; in the locked position of FIG. 16, rod section 305*b* extends adjacent the corresponding side of the base member 101 and equipment 102. Still in the locked position of FIG. 16, rod section 305*c* extends horizontally and inwardly from right angle 305*g* to right angle 305*h* over the top face of equipment 102. Rod section 305*d* extends horizontally and forwardly over the top face of equipment 102 from right angle 305*h* to right angle 305*i*. Rod section 305*e* extends vertically and downwardly from right angle 305*i* to key lock 306 adjacent the front side of equipment 102 and the front wall 135 of base member 101.

Key lock 306 is identical to key lock 115 of FIG. 10 and will lock the rod sections 304*e* and 305*e* to the front wall 135 of base member 101 through the vertical slots 133 and 134 and the rectangular opening 136.

In operation, key lock 306 is unlocked and the rod 304—rod 305—key lock 306 assembly is pivoted about rod sections 304*a* and 305*a* until the position of FIG. 15 is reached. Equipment 102, a laptop computer in the illustrated example, is positioned on the base member 101. The laptop computer 102 can then be unfolded to enable use thereof.

The rod 304—rod 305—key lock 306 assembly can then be pivoted about rod sections 304*a* and 305*a* back to the position of FIG. 16. Key lock 306 is finally locked to thereby lock the rod 304—rod 305—key lock 306 assembly on the base member 101.

The equipment 102 (laptop computer in the illustrated example) then confined within a space delimited by base member 101, the pair of rods 304 and 305 and the U-shaped vertically extending movement-restraining rod member 301 to prevent theft and tampering of the equipment. Since the base member 101 is secured to a surrounding structure (not shown), theft of the equipment 102 is prevented.

Of course, it is within the scope of the present invention to use the second, third and fourth embodiments to lock an equipment other than a laptop computer.

Although the present invention has been described by way of a preferred embodiment thereof, it is contemplated that various modifications may be made thereto without departing from the spirit and scope of the present invention. Accordingly, it is intended that the embodiments described be considered only as illustrative of the present invention and that the scope thereof should not be limited thereto but be determined by reference to the claims hereinafter provided and their equivalents.

What is claimed is:

1. A security apparatus for preventing theft and/or tampering of an equipment or a part of said equipment, comprising:

(a) a base member having a peripheral portion;

(b) an equipment-restraining assembly comprising:

first spaced apart portions through which, in operation, the equipment-restraining assembly is secured to corresponding spaced apart points of the peripheral portion of the base member;

second, third and fourth portions which, in operation, extend along first, second and third generally vertical faces of the equipment, respectively, the second face being substantially opposite to the third face; and a fifth portion which, in operation, extends along a fourth top face of the equipment; and (c) a locking member which, in operation, extends along a fifth generally vertical face of the equipment generally opposite to the first face, said locking member comprising a lock mechanism which, in operation, removably locks the locking member to the base member in order to confine the equipment within a space delimited by the base member, the second, third, fourth and fifth portions, and the locking member;

wherein the security apparatus further comprises a cable means having one end locked to said security apparatus and a second end locked to a non transportable structure for thereby locking the apparatus.

2. A security apparatus for preventing theft and/or tampering of an equipment or a part of said equipment, comprising:

(a) a base member having a peripheral portion;

(b) first and second elongated bent rods each including:

A first end rod section to secure the elongated bent rod to a first point of the peripheral portion;

a second end rod section to secure the elongated bent rod to a second point of the peripheral portion spaced apart from the first point;

a third rod section to extend along a rear face of the equipment;

a fourth rod section to extend along a top face of the equipment; and the first and second elongated bent rods further comprising respective fifth rod sections to extend along two opposite side faces of the equipment, respectively; and (c) at least one movement-restraining member to extend along a front face of the equipment, said at least one movement-restraining member comprising a lock mechanism through which, in operation, said at least one movement-restraining member is removably locked to the base member in order to confine the equipment within a space delimited by the base member, the first and second elongated bent rods, and said at least one movement-restraining member.

3. A security apparatus as recited in claim 2, wherein said first and second elongated bent rods are of generally circular cross section.

4. A security apparatus as recited in claim 2, further comprising a bridging member for interconnecting the fourth sections of the first and second elongated bent rods.

5. A security apparatus for preventing theft and/or tampering of an equipment or a part of said equipment, comprising:

(a) a base member having a peripheral portion;

(b) first and second elongated bent members each including:

a first end section to secure the elongated bent member to a first point of the peripheral portion;

a second end section to secure the elongated bent member to a second point of the peripheral portion spaced apart from the first point;

a third section to extend along a rear face of the equipment;

a fourth section to extend along a top face of the equipment; and the first and second elongated bent members further comprising respective fifth sections to extend along two opposite side faces of the equipment, respectively; and (c) at least one movement-restraining member to extend along a front face of the equipment, said at least one movement-restraining member comprising a lock mechanism through which, in operation, said at least one movement-restraining member is removably locked to the base member in order to confine the equipment within a space delimited by the base member, the first and second elongated bent members, and said at least one movement-restraining member;

(d) fasteners which, in operation, secure the first and second end sections of each elongated bent member to the first and second points of the peripheral portion, said fasteners being inaccessible when the equipment is confined within said space;

wherein the peripheral portion of the base member comprises:

a first side wall;

a rear wall; and a second side wall opposite to the first side wall; and wherein:

the first end section of the first elongated bent member is secured to a point of the peripheral portion situated on the rear wall;

the second end section of the first elongated bent member is secured to a point of the peripheral portion situated on the first side wall;

the first end section of the second elongated bent member is secured to a point of the peripheral portion situated on the rear wall; and the second end section of the second elongated bent member is secured to a point of the peripheral portion situated on the second side wall.

6. A security apparatus for preventing theft and/or tampering of an equipment or a part of said equipment, comprising:

(a) a base member having a peripheral portion;

(b) first and second elongated bent members each including:

a first end section to secure the elongated bent member to a first point of the peripheral portion;

a second end section to secure the elongated bent member to a second point of the peripheral portion spaced apart from the first point;

a third section to extend along a rear face of the equipment;

a fourth section to extend along a top face of the equipment; and the first and second elongated bent members further comprising respective fifth sections to extend along two opposite side faces of the equipment, respectively; and (c) at least one movement-restraining member to extend along a front face of the equipment, said at least one movement-restraining member comprising a lock mechanism through which, in operation, said at least one movement-restraining member is removably locked to the base member in order to confine the equipment within a space delimited by the base member, the first and second elongated bent members, and said at least one movement-restraining member;

wherein the security apparatus further comprises a mechanical position-adjusting system interposed between the base member and the first and second end sections of each of said first and second elongated bent members, said mechanical position-adjusting system having mechanisms of adjustment of the position of the first and second elongated members along three orthogonal axes, thereby enabling adaptation of the dimensions of the security apparatus to equipments of different sizes and shapes.

7. A security apparatus as recited in claim 6, in which said position adjustment mechanisms of the mechanical position-adjusting system comprises for each end section of the first and second elongated bent members:

a set of superposed, horizontal slots made in a generally vertical outer wall of the peripheral portion of the base member;

a bushing assembly for locking the end section into a selected one of the superposed, horizontal slots; wherein the bushing assembly comprises:

a bushing member for receiving the end section, said bushing member having a head portion and a generally flattened threaded portion for insertion into and displacement along the selected slot;

a nut for engaging the generally flattened threaded portion to lock the bushing member in the slot at a desired position along said selected slot; and means for locking the end section in the bushing member at a desired position.

8. A security apparatus for preventing theft and/or tampering of an equipment or a part of said equipment, comprising:

(a) a base member having a peripheral portion;

(b) first and second elongated bent members each including:

a first end section to secure the elongated bent member to a first point of the peripheral portion;

a second end section to secure the elongated bent member to a second point of the peripheral portion spaced apart from the first point:

a third section to extend along a rear face of the equipment;

a fourth section to extend along a top face of the equipment; and the first and second elongated bent members further comprising respective fifth sections to extend along two opposite side faces of the equipment, respectively; and (c) at least one movement-restraining member to extend along a front face of the equipment, said at least one movement-restraining member comprising a lock mechanism through which, in operation, said at least one movement-restraining member is removably locked to the base member in order to confine the equipment within a space delimited by the base member, the first and second elongated bent members, and said at least one movement-restraining member;

wherein said security apparatus further comprises means for adjusting the position of the movement-restraining member along a front wall of the peripheral portion of the base member.

9. A security apparatus for preventing theft and/or tampering of an equipment or a pert of said equipment, comprising:

(a) a base member having a peripheral portion;

(b) first and second elongated bent members each including;

a first end section to secure the elongated bent member to a first point of the peripheral portion;

a second end section to secure the elongated bent member to a second point of the peripheral portion spaced apart from the first point;

a third section to extend along a rear face of the equipment;

a fourth section to extend along a top face of the equipment; and the first and second elongated bent members further comprising respective fifth sections to extend along two opposite side faces of the equipment, respectively; and (c) at least one movement-restraining member to extend along a front face of the equipment, said at least one movement-restraining member comprising a lock mechanism through which, in operation, said at least one movement-restraining member is removably locked to the base member in order to confine the equipment within a space delimited by the base member, the first and second elongated bent members, and said at least one movement-restraining member;

wherein said fourth member sections of the first and second elongated bent members define a collar for encircling and holding a base of a second piece of equipment.

10. A security apparatus for preventing theft and/or tampering of an equipment or a part of said equipment, comprising:

(a) a base member having a peripheral portion;

(b) an equipment-restraining assembly comprising:

first spaced apart portions through which, in operation, the equipment-restraining assembly is secured to corresponding spaced apart points of the peripheral portion of the base member;

second, third and fourth portions which, in operation, extend along first, second and third generally vertical faces of the equipment, respectively, the second face being substantially opposite to the third face; and a fifth portion which, in operation, extends along a fourth top face of the equipment; and (c) a locking member which, in operation, extends along a fifth generally vertical face of the equipment generally opposite to the first face, said locking member comprising a lock mechanism which, in operation, removably locks the locking member to the base member in order to confine the equipment within a space delimited by the base member, the second, third, fourth and fifth portions, and the locking member;

wherein said security apparatus further comprises a drawer structure sliding on the base member between extended and retracted positions, wherein:

said drawer structure comprises a top face on which the equipment is placed, and a front face on which said locking member, including the lock mechanism are mounted;

in the retracted position of the drawer structure, the locking member extends along the fifth generally vertical face of the equipment; and the peripheral portion of the base member comprises a lock-receiving structure which, in operation, receives the lock mechanism in order to removably lock both the drawer structure and the locking member to the base member in order to confine the equipment within said space delimited by the base member, the second, third, fourth and fifth portions, and the locking member.

11. A security apparatus as recited in claim 10 wherein, since the equipment is placed on the top face of the drawer structure, said equipment slides with said drawer structure, and wherein, in the extended position of the drawer structure, said drawer structure, said equipment-restraining assembly, and said locking member present a configuration defining a clearance sufficient for enabling use of said equipment.

12. A security apparatus for preventing theft and/or tampering of an equipment or a part of said equipment, comprising:

(a) a base member having a peripheral portion;

(b) first and second elongated bent members each including:

a first end section to secure the elongated bent member to a first point of the peripheral portion;

a second end section to secure the elongated bent member to a second point of the peripheral portion spaced apart from the first point;

a third section to extend along a rear face of the equipment;

a fourth section to extend along a top face of the equipment; and the first and second elongated bent members further comprising respective fifth sections to extend along two opposite side faces of the equipment, respectively; and (c) at least one movement-restraining member to extend along a front face of the equipment, said at least one movement-restraining member comprising a lock mechanism through which, in operation, said at least one movement-restraining member is removably locked to the base member in order to confine the equipment within a space delimited by the base member, the first and second elongated bent members, and said at least one movement-restraining member;

wherein said security apparatus further comprises a drawer structure sliding on the base member between extended and retracted positions, wherein:

said drawer structure comprises a top face on which the equipment is placed, and a front face on which said at least one movement-restraining member, including the lock mechanism are mounted;

in the retracted position of the drawer structure, said at least one movement-restraining member extends along the front face of the equipment; and the peripheral portion of the base member comprises a lock-receiving structure which, in operation, receives the lock mechanism in order to removably lock both the drawer structure and said at least one movement-restraining member to the base member in order to confine the equipment within said space delimited by the base member, the first and second elongated bent members, and said at least one movement-restraining member.

13. A security apparatus as recited in claim 12 wherein, since the equipment is placed on the top face of the drawer structure, said equipment slides with said drawer structure, and wherein, in the extended position of the drawer structure, said drawer structure, said first and second elongated bent members, and said at least one movement-restraining member present a configuration defining a clearance sufficient for enabling use of said equipment.

14. A security apparatus for preventing theft and/or tampering of an equipment or a part of said equipment, comprising:

(a) a base member having a peripheral portion;

(b) a movement-restraining member which, in operation, is secured to the peripheral portion of the base member and extends along a first generally vertical face of the equipment;

(c) a pivotal equipment-restraining assembly comprising: a first elongated movement-restraining bent rod including (a) a first rod portion pivotally connecting the first bent rod to the peripheral portion of the base member, (b) a second rod portion to extend along a second generally vertical face of the equipment, (c) a third rod portion to extend along a third top face of the equipment, and (d) a fourth rod portion to extend along a fourth generally vertical face of the equipment opposite to said first face; and a second elongated movement-restraining bent rod including (a) a first rod portion pivotally connecting the second elongated movement-restraining rod to the peripheral portion of the base member, said first portions of the first and second bent rods being pivotally connected on opposite sides of the peripheral portion of the base member, (b) a second rod portion to extend along a fifth generally vertical face of the equipment generally opposite to the second face, (c) a third rod portion to extend along the third top face of the equipment, and (d) a fourth rod portion to extend along the fourth generally vertical face of the equipment; and a locking member connected to the fourth portions of the first and second elongated movement-restraining bent rods, said locking member comprising a lock mechanism which, in operation, locks the locking member to the base member and thereby confine the equipment within a space delimited by the base member, the movement-restraining member, and the first and second elongated movement-restraining rods.

15. A security apparatus as recited in claim 14, wherein said first and second elongated movement-restraining bent rods are of generally circular cross section.

* * * * *